US005813185A

United States Patent [19]

Jackson

[11] Patent Number: 5,813,185

[45] Date of Patent: Sep. 29, 1998

[54] SPACER RECIEVER FOR A WALL FORM TIE ROD

[76] Inventor: George W. Jackson, Suit 1107-1535 Lake Shore Rd., Mississauga Ontario, Canada, L5EJE2

[21] Appl. No.: 639,574

[22] Filed: Apr. 29, 1996

[51] Int. Cl.[6] ..... E04B 1/02; E04C 3/30

[52] U.S. Cl. ..... 52/562; 52/567; 52/742.15; 52/730.5; 52/405.1; 52/570; 52/699; 52/701; 411/427; 411/432; 411/901; 411/903

[58] Field of Search ..... 52/562, 567, 742.15, 52/730.5, 405.1, 570, 587.1, 699, 701; 411/427, 432, 901–903

[56] References Cited

U.S. PATENT DOCUMENTS

| | | | |
|---|---|---|---|
| 766,206 | 8/1904 | Westling | 411/432 X |
| 3,110,755 | 11/1963 | Esser | 411/902 X |
| 3,460,721 | 8/1969 | Hamel et al. | 411/427 X |
| 3,503,584 | 3/1970 | Erhert et al. | 411/427 X |
| 4,373,309 | 2/1983 | Lutz | 411/427 X |
| 4,486,133 | 12/1984 | Pletcher | 411/427 X |
| 4,836,727 | 6/1989 | Volkmann | 411/903 X |
| 4,990,044 | 2/1991 | Kimak | 411/427 |

*Primary Examiner*—Christopher Kent
*Assistant Examiner*—W. Glenn Edwards
*Attorney, Agent, or Firm*—Gowling, Strathy & Henderson

[57] ABSTRACT

A tie rod assembly for use with forms for forming a wall of pourable, curable material. Each assembly has a rod having opposite threaded ends and two spacers. Each of the spacers has a first conical section having a recessed opening at an apex region of a concave conical guide surface and a hexagonal recess surrounding the apex region, and a second conical section having a threaded bore communicating with the apex opening. The threaded bore has a coil thread nut integrated with the conical second section. The concave conical guide presents a target for directing a remotely inserted bolt towards the apex region for engagement with the coil thread nut.

12 Claims, 2 Drawing Sheets

SPACER RECIEVER FOR A WALL FORM TIE ROD

FIELD OF INVENTION

This invention relates to a spacer and combined receiver for a wall form tie rod. assembly. In particular, this invention relates to a spacer for improving the efficiency in the use of tie rods.

BACKGROUND OF THE INVENTION

In the construction industry, wall forms are widely used to manufacture concrete walls. The forms are often wooden faced and must be readily assembled and disassembled. Typically, a set of forms is prepared and set to receive liquid or pourable concrete which after curing forms a wall structure. The forms are then removed and respectively set up for additional wall structures to be formed.

The panels of the wall forms are connected together in various formats usually with tie rods to provide a mold in which reinforcement steel bars can be placed and concrete poured. The size of the panels and spacing of tie rods are generally dictated by the type of application and the strength of the rods.

All forms have to overcome the problem of panel face deflection under loading. Tie rods are used to join opposed panels of wall forms together, until the concrete is poured and set. The use of tie rods with spacers acts to space apart the opposed wall form panels and hold the panels straight and in-line. The end result is an improved wall having uniform thickness. Such tie rods are described in U.S. Pat. No. 4,234,156.

The tie rod of U.S. Pat. No. 4,234,156 uses a lengthy tie rod or flat bar, which extends through the walls, and usually remains in the cured concrete wall. The ends of the bars are broken off leaving the ends recessed from the opposite wall faces. One problem with this type of tie rod is that the broken off end is subject to rusting and bleeding. These types of rods have to extend through both forms, through the spacers and also through the wailer systems on both sides of the forms, and thus are required to be quite long. The rods are relatively expensive and since they are broken off with parts staying in the concrete, the complete rod becomes waste. These types of tie rods also make the stripping process slow and difficult as the ends of the rods are quite long and protrude through the wall panels.

Still other tie rods are available. These ties rods have threads on both ends thereof and are often called she bolts. A spacer is threaded onto each of the ends of the tie rod and then external rods are threaded into each end of the spacers for spacing and attachment to the wall form wailers. Such tie rods have the advantage of being able to be installed one side at a time, after one form has been put in place and before the opposed form is positioned. Once the opposed form is positioned, a second external rod is threaded through the opposed form to threadingly engage with the second spacer. Such tie rods are disclosed in Canadian Patent application no. 2,147,023 and are also commercially available under the trademarks WILLIAMS COIL STRUT TIE ROD FORMING SYSTEM, TAPER-TY and RICHMOND SHE-BOLT ASSEMBLIES.

The difficulty with this latter type of tie rods is that the spacer has a threaded opening. When positioning a form, the holes in the form through which the tie rods extend generally do not exactly line up with the threaded opening of the tie rod assembly. When an installer inserts the second external rod through the hole, it is very time consuming to get the second external rod to align with and then threadingly engage the spacer.

SUMMARY OF THE INVENTION

The disadvantages of the prior art may be overcome by providing for a tie rod she bolt assembly, a spacer having a concave guide surface presenting a relatively large target for directing a remotely inserted rod towards an apex of the guide surface to threadingly engage with a threaded bore of the spacer, providing fast installation and a controlled width of a concrete wall.

According to one aspect of the invention, there is provided a tie rod she bolt assembly for use with forms for forming a wall of pourable, curable material. Each assembly has a rod having opposite threaded ends or a continuous threaded rod and two nut spacers threadingly engaging each end of the rod. Each of the nut spacers has a first conical section having a recessed opening at an apex region of a concave conical guide surface and a hexagonal or other shaped recess surrounding the inside apex region, and a second or continued conical section having a threaded bore communicating with the apex opening. The threaded bore of the nut spacer has a threaded nut integrated with the second or continuous conical section. The concave conical guide presents a target for and directing a remotely inserted she bolt towards the apex region for engagement with each of the nut spacers internal threaded nut. The hexagonal recess provides a means for applying a torque to the spacer for removing it from a cured wall.

According to another aspect of the invention, there is provided a spacer for use with a form for forming a wall of pourable, curable material. Each spacer has a first conical section having a recessed opening at an apex region of a concave conical guide surface and a hexagonal recess surrounding the apex region, and a second conical or continuous section having a threaded bore communicating with the apex opening. The threaded bore has a threaded nut integrated with the second or continuous conical section. The concave conical guide presents a target and directs a remotely inserted bolt towards the apex region for engagement with the threaded nut section. The hexagonal or other recess provides a means for applying a torque to the spacer for removing it from a cured wall.

DESCRIPTION OF THE DRAWINGS

In Figures which illustrate embodiments of the invention.

DETAILED DESCRIPTION OF THE INVENTION

Figure 1:
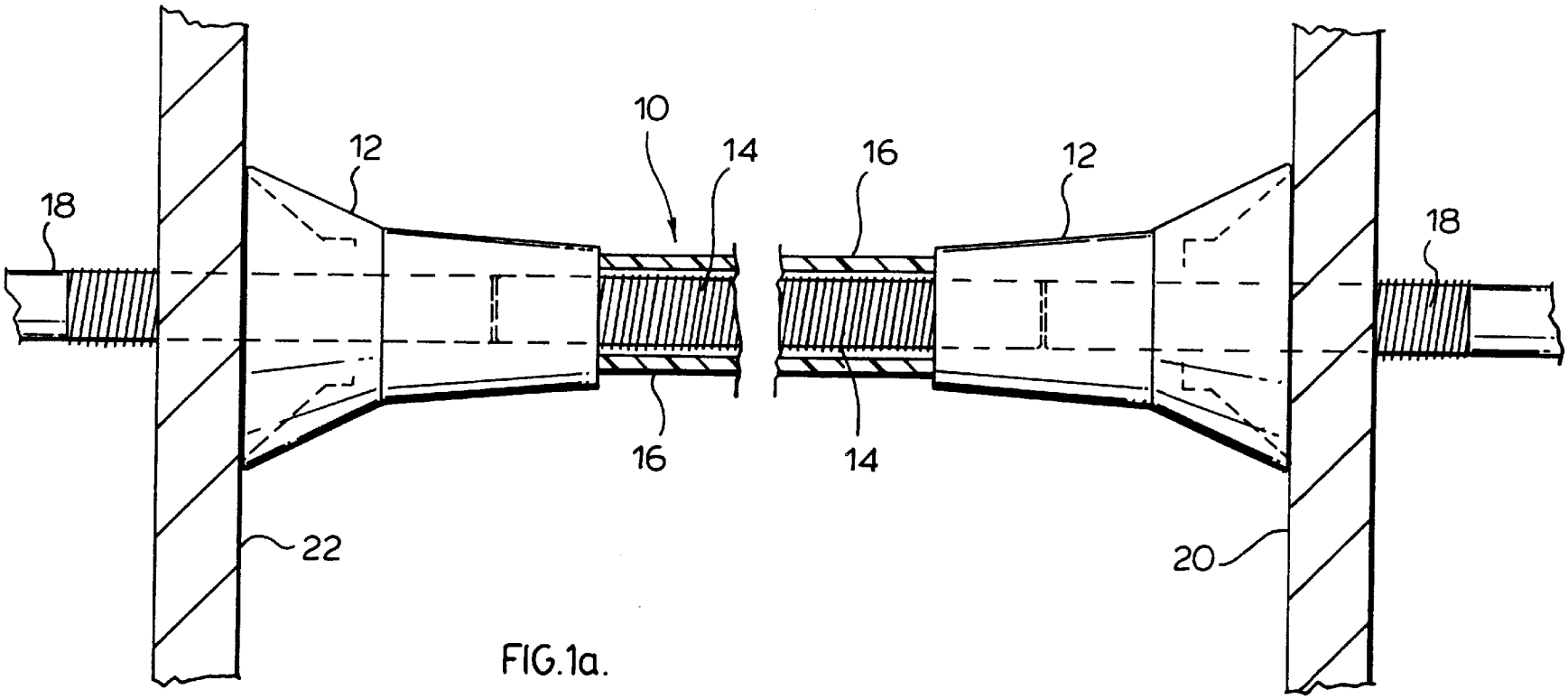
FIG. 1 is a top plan view of the tie rod assembly incorporating the present invention.

The tie rod assembly 10 of the present invention is illustrated in FIG. 1. The tie rod assembly 10 generally comprises a conical nut spacer 12, a tie rod 14, a tube 16, which is optional, and external rods or she bolts 18. Tie rod assembly 10 extends between two forms 20 and 22, each having an aperture for receiving external rods 18.

Figure 1A:
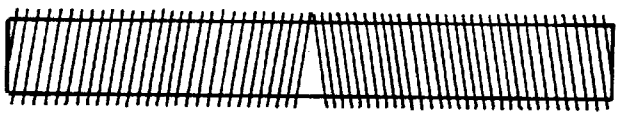
FIG. 1*a* is an elevational view of a second embodiment of the tie rod of the present invention.

Tie rod 14 has either a single thread extending along its entire length as illustrated in FIG. 1 or alternatively, threads at opposite ends as illustrated in FIG. 1*a*. It is readily apparent to those skilled in the art to use the desired direction for the threads.

Figure 2:
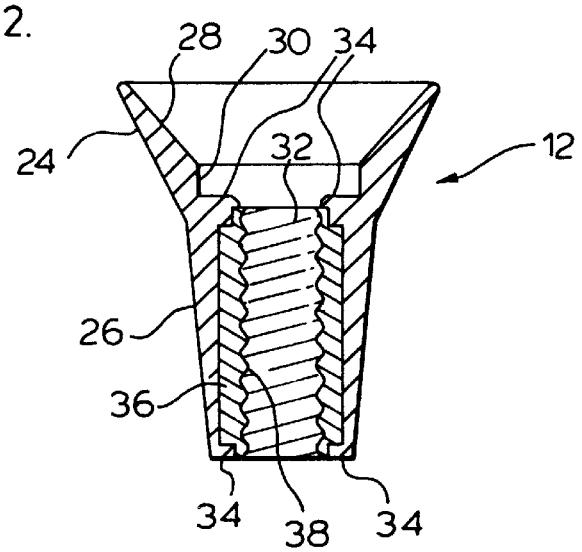
FIG. 2 is a side sectional view of the spacer of the assembly of FIG. 1.
Figure 3:
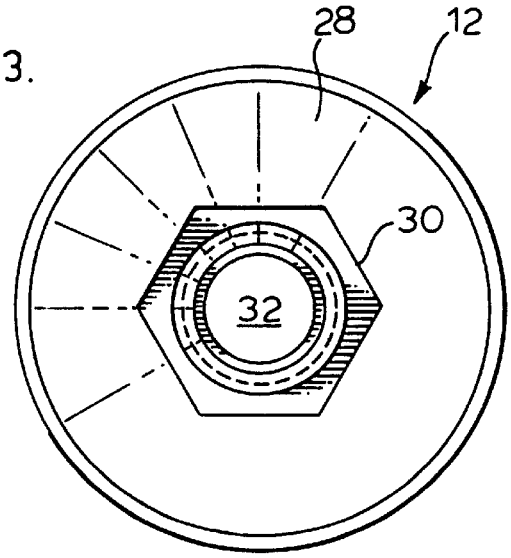
FIG. 3 is a top plan view of the spacer of FIG. 2.

Referring to FIGS. 2 and 3, the conical nut spacer of the present invention is illustrated in greater detail. Nut spacer 12 has a first conical section 24 coaxially extending with a second conical section 26. The outside taper of conical section 24 preferably is greater than that of conical section 26. Optionally, first conical section 24 and second conical section 26 may have a single taper to save material and weight and to keep the hole in the cured concrete wall as small as possible.

Conical section 24 has a concave internal conical guide surface 28. At the apex region of the conical surface 28 is a hexagonal recess 30. Optionally, recess 30 could be an octagon or square or other suitable shape. Extending through conical section 26 is a through bore 32 having flanges 34. Within through bore 32 is an internal thread nut 36, having an internal thread 38.

Nut 36 must be integrated with the conical section 26. Flanges 34 restrain longitudinal relative movement of the coil thread nut 36. One method of integration is to have nut 36 made of a metal and conical sections 24 and 26 made of a plastic material. Spacer 10 can be molded directly about the nut 36 or otherwise bonded thereto. Any conventional method of bonding a metal to a plastic may be used.

Figure 4:
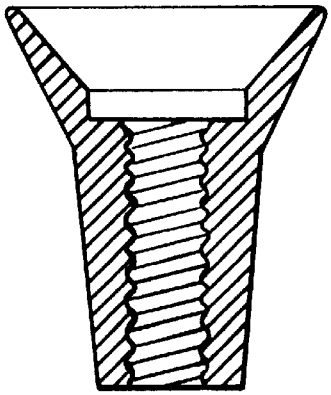
FIG. 4 is a side sectional view of the spacer of another embodiment of the present invention.

Another method of integration is to have the spacer 10 made all of steel or other material, as illustrated in FIG. 4. The conical spacer nuts can be made of a variety of materials, such as steel or brass using conventional casting methods.

Conical surface 28 presents a guide for directing an end of an external rod 18 towards the apex region and ultimately towards internal thread 38. The relatively wide opening presented by the mouth of the conical surface 28 makes it easier for an installer to remotely push a probing external rod 18 through tie rod holes in the forms 20, 22 to actually engage the internal thread 38.

As it can be appreciated, it is very difficult and time consuming to align the forms 20, 22 so that the holes for the tie rods on opposed forms align perfectly to allow easy insertion. The relatively small target of the bore 32 on a prior art tie rod assembly requires the forms to be very precisely positioned. The increased target area presented by the mouth of the conical surface 28 reduces the precision required and thus decreases the time and effort for installation.

The tie rod assemblies 10 incorporating the nut spacer 12 may be used in the conventional manner to space and retain opposed forms for concrete wall production. A spacer 12 is threaded onto the opposite ends of tie rod 14 approximately half of the length of internal thread 38. Tube 16 may be installed onto tie rod 14. Tube 16 is used if it is desired to remove the tie rod 14 from the formed wall after curing. Tube 16 may also act as a measuring device to automatically space the opposed nut spacers 12 along tie rod 14 and set the length of tie rod assembly 10 to be the desired thickness of the concrete wall. Tube 16 is conventionally used only for above ground applications. Below grade applications, tube 16 is generally not used. Tie rod 14 is left within the concrete wall to minimize moisture transfer therethrough.

In either case, tie rod 14 should extend approximately half way along internal thread 38 of each spacer 12. The amount of insertion can be controlled by stops on rod 14 at the desired lengths. A stop may be made by flattening the rod at the desired location prevention.

The installer inserts an external rod or she bolt through one of the tie rod holes in the form 20. The spacer 12 is presented to the external thread on the end of the she bolt 18. The external thread engages the bore 32 to threadingly engage nut 38. Spacer 12 is threaded approximately half of the length of the internal thread 38. She bolt 18 which has an external thread at the other end, or has a continuous external thread is then tightened holding the form 20 and the spacer 12 tight to the form.

The opposed form 22 is later installed at the distance of the spacer length equal to the desired thickness of the wall to be poured. Opposed form 22 is then aligned with form 20 such that the axis of the tie rod assembly 10 is coaxial with the center of the tie rod holes in form 22. As can be appreciated, tie rod apertures are relatively small and alignment is difficult. The conical section 24 has a mouth with a radius which is greater than the bore 32, presenting a larger target for the probing opposed she bolt 18. The guide surface 28 will deflect a probing she bolt towards the bore 32 to engage with nut thread 36. The larger the target results in easier and less precise positioning of the opposed form 22. Ultimately, the installer can install the forms more efficiently and quicker and the tie rod assembly 10 provides the exact width of the wall to be poured.

Once the poured concrete has cured to a solid, external rods or she bolts 18 may be unthreaded and removed, allowing the forms 20 and 22 to be removed. A hex wrench or other suitable torque means may be presented to the hex recess 30 for applying a torque to rotate and unthread spacer 12 from tie rod 14 for removal from the cured concrete wall.

If a tube 16 is used, tie rod 14 is free to rotate and be removed. If a tube 16 was not used, tie rod 14 will be firmly embedded in the concrete wall preventing rotation and leakage.

Once the spacers 12 have been removed, the conical-shaped holes in the concrete wall can be plugged with plastic or otherwise plugged with a sealing compound.

Although the disclosure describes and illustrates the preferred embodiments of the invention, it is understood that the invention is not limited to these particular embodiments. Many variations and modifications will now occur to those skilled in the art. For definition of the invention, reference is made to the appended claims.

I claim:

1. A tie rod assembly for use in assembling at least two opposed wall forms for forming a mold for a wall of pourable, curable material comprising a rod having opposite threaded ends, and fastener means for attaching the rod to a first wall form through an aperture therein;

a nut spacer for attaching to an end of said rod, said nut spacer having a first section having a substantially conical, recessed guide surface for directing a probing rod extending through an aperture in an opposed wall form towards an opening at an apex region of said guide surface, said guide surface presenting a guide opening larger than said apex opening, and a second section axially extending from the first section and having a threaded bore communicating with said apex opening for engaging said rod at an end of the threaded bore opposite the apex opening.

2. A tie rod assembly as claimed in claim 1 wherein said spacer has a shaped recess at the apex region for drivingly receiving a torque applying means for disengaging the assembly after the concrete has set.

3. A tie rod assembly as claimed in claim 1 wherein said threaded bore is a threaded nut integrated with said second section.

4. A tie rod assembly as claimed in claim 1 wherein said first section and said second section are conically shaped and said first section has a taper greater than that of said second section.

5. A tie rod assembly as claimed in claim 1 wherein said guide surface has a conical shape to guide and direct a receiving connecting rod.

6. A tie rod assembly for use with wall forms for forming a mold for a wall of pourable, curable material comprising a rod having opposite threaded ends and two spacers threadingly engaging said opposite threaded ends, each of said spacers having a first conical section having a recessed opening at an apex region of a concave conical guide surface and a shaped recess near the apex region, and a second conical section having a threaded bore communicating with said recessed opening and engaging said rod, said threaded bore comprising a threaded nut integrated with said conical second section.

7. A spacer for use with a tie rod assembly for use with wall forms for forming a mold for a wall of pourable, curable material, said spacer having a first section having a substantially conical, recessed opening at an apex region of a guide surface and a second section having a threaded bore communicating with said recessed opening, wherein said guide surface directs a remotely inserted threaded rod towards said apex opening for threadingly engaging with said threaded bore.

8. A spacer as claimed in claim 7 wherein said spacer has a shaped recess at the apex region for drivingly receiving a torque applying means.

9. A spacer as claimed in claim 7 wherein said threaded bore is a coil thread nut integrated with said second section.

10. A spacer as claimed in claim 7 wherein said first section and said second section are conically shaped and said first section has a taper greater than that of said second section.

11. A spacer as claimed in claim 7 wherein said guide surface has a conical shape.

12. A wall form assembly for forming a mold for a wall of pourable, curable material, comprising:

a first wall form having a plurality of apertures therethrough;

a second wall from, opposed to said first wall form, having corresponding apertures therethrough;

tie rods, each having opposite threaded ends and fastener means for attaching said rods to said first wall form through said apertures in said first wall form;

nut spacers for attaching to an end of each said rod, said nut spacers each having a first section having a substantially conical, recessed guide surface for directing a probing rod extending through a corresponding aperture in said second opposed wall form towards an opening at an apex region of said guide surface, said guide surface presenting a guide opening larger than said apex opening, and a second section axially extending from the first section and having a threaded bore communicating with said apex opening for engaging said rod at an end of the threaded bore opposite the apex opening.

* * * * *